US007367137B2

(12) United States Patent
Jonsson et al.

(10) Patent No.: US 7,367,137 B2
(45) Date of Patent: May 6, 2008

(54) CLOTHES TREATING ULTRASONIC NEBULIZING CABINET APPARATUS

(75) Inventors: Stefan A. Jonsson, Stockholm (SE); Christer Wiss, Lidingo (SE); Rica Pantermehl, Cordenons (IT); Maurizio Del Pos, Pordenone (IT); Jean-Yves Noel, Sacile (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 0 days.

(21) Appl. No.: 10/561,742

(22) PCT Filed: Jun. 23, 2004

(86) PCT No.: PCT/EP2004/051212

§ 371 (c)(1),
(2), (4) Date: Mar. 23, 2006

(87) PCT Pub. No.: WO2005/001191

PCT Pub. Date: Jan. 6, 2005

(65) Prior Publication Data

US 2006/0179678 A1 Aug. 17, 2006

(30) Foreign Application Priority Data

Jun. 25, 2003 (EP) ..... 03014241

(51) Int. Cl.
*F26B 3/34* (2006.01)

(52) U.S. Cl. ..... 34/265

(58) Field of Classification Search ..... 34/265
See application file for complete search history.

(56) References Cited

U.S. PATENT DOCUMENTS

| | | | | |
|---|---|---|---|---|
| 5,016,364 | A | 5/1991 | Cochrane | |
| 5,433,919 | A | 7/1995 | Baltes | |
| 5,815,961 | A | 10/1998 | Estes et al. | |
| 6,189,346 | B1 | 2/2001 | Chen et al. | |
| 6,745,496 | B2 * | 6/2004 | Cassella | 34/621 |

(Continued)

FOREIGN PATENT DOCUMENTS

| | | |
|---|---|---|
| EP | 0 080 790 | 6/1983 |

(Continued)

OTHER PUBLICATIONS

Patent Abstracts of Japan, vol. 1999, No. 12, Oct. 29, 1999 & JP 11-189968, Jul. 13, 1999.

(Continued)

*Primary Examiner*—S. Gravini
(74) *Attorney, Agent, or Firm*—Pearne & Gordon LLP

(57) ABSTRACT

A clothes treating apparatus comprising a cabinet (1) having external walls (2) and internal walls (3), said internal walls (3) defining an interior region (4) for receiving clothes, said apparatus further comprising a door (6) connected to said cabinet (1), at least a supporting device (5) for supporting clothes within said interior region, a ventilator (7), water supply means (8) and an ultrasonic nebulizer (9) operatively associated to said water supply means (8). Said apparatus is characterized in that the air within the interior region (4) is recirculated by said ventilator (7) through an air duct (10) located between said internal walls (3) and said external walls (2) forming a closed loop with said internal region.

18 Claims, 4 Drawing Sheets

U.S. PATENT DOCUMENTS

2002/0053607 A1* 5/2002 Gaaloul et al. ..... 239/102.2

FOREIGN PATENT DOCUMENTS

| | | |
|---|---|---|
| EP | 0 148 385 | 7/1985 |
| EP | 0 479 241 | 4/1992 |
| EP | 1 057 923 | 12/2000 |
| EP | 1 182 292 | 2/2002 |
| FR | 2 702 377 | 9/1994 |
| GB | 1062979 | 3/1967 |

OTHER PUBLICATIONS

Patent Abstracts of Japan, vol. 2002, No. 10, Oct. 10, 2002 & JP 2002-159431, Jun. 4, 2002.

* cited by examiner

FIG. 1
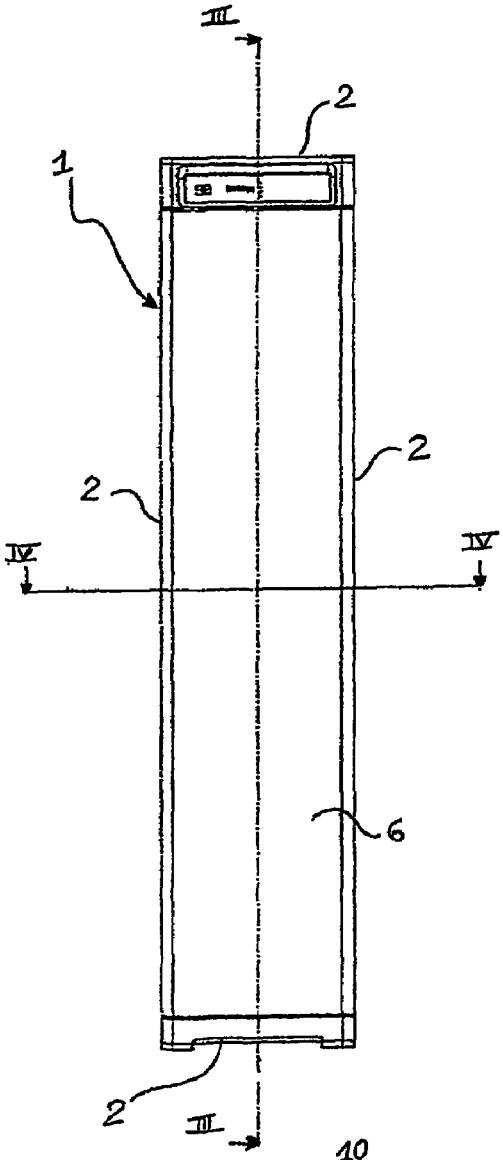
FIG. 2
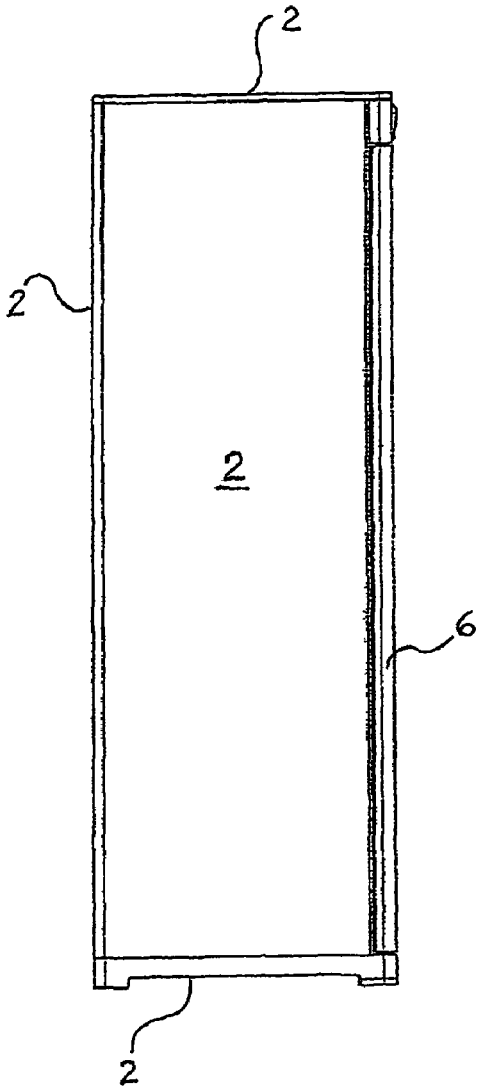
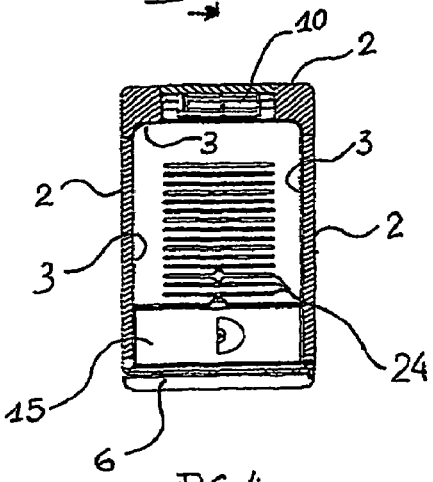
FIG. 4

CLOTHES TREATING ULTRASONIC NEBULIZING CABINET APPARATUS

This application claims the benefit of International Application Number PCT/EP2004/051212, which was published in English on Jan. 6, 2005.

The present invention refers to a clothes treating apparatus for refreshing a garment removing odours and wrinkles without using steam, mechanical tensioning devices or chemicals substances adapted to impart refreshing and/or cleaning benefits. The same apparatus is adapted to work as a drying cabinet when needed.

The use of steaming clothes cabinet to dewrinke garments is well know in the art. For example, U.S. Pat. No. 5,815,961 discloses a clothes treating machine comprising a steam generator located in the lower region of the garments housing; a fan and heating means are also provided to deliver hot air in said housing for drying clothes or for introducing moist air to freshen and remove wrinkles from clothes. The air to be heated is taken from the atmosphere and it is exhausted from the garments housing by passing through an exhaust duct disposed in the upper part of the machine. Furthermore, the steaming machine disclosed in the cited U.S. Patent includes also weighted clamps and an inflatable hanger for pressing clothes items, said hanger is inflated by a dedicated blower.

This type of clothes cabinet has been found to have many drawbacks. In fact, the use of steam for the dewrinkling process needs an appreciable amount of time for generating the steam starting from water. For this reason the dewrinkiling action cannot be immediately available as soon as the machine is operated. The whole time process is consequently increased and any solution proposed to reduce this time causes an undesirable increase of energy consumption and/or an increase of the heating means costs. A further drawback is that the moist air is exhausted into the room where the steaming machine is installed. This is particularly unpleasant when said machine is designed for a domestic use. A connection of the exhausting port with a duct work is not a complete solution to the problem because it determinates a further increase of the machine installing costs. Again, a drawback of the U.S. Pat. No. 5,815,961 disclosure is that the application of an inflatable hanger requires not only a large garments region but also the use of an additional blower. This causes an increase of the machine dimensions, weight and cost. Not even the use of weighted clamps enhances particularly the dewrinkling performances because the clamps themselves cause little wrinkles on the garment regions where they are applied.

Another kind of clothes treating machine is known from U.S. Pat. No. 6,189,346. In this document a refreshing machine that does not use steam is disclosed. The deodorizing, dewrinkling and even cleaning effects are obtained by the use of a chemicals composition sprayed onto the garments in a controlled manner. To this aim the machine disclosed in said Patent is provided with a compressor connected to an air supply tube which supplies air to a nozzle. The conditioning composition is supplied to the nozzle from a reservoir container. The chemicals composition is dispensed within the cabinet interior region by combining it with the air stream under pressure provided by the compressor and passing it through the atomization nozzle. To provide for heating and moving air within the cabinet, a recirculation fan assembly is provided in said interior region.

In the machine described in U.S. Pat. No. 6,189,346 the conditioning composition cannot be homogeneously distributed in the entire interior region because said distribution is operated by an air flow recirculation which is obstructed by the clothes themselves. Evidently, the most of the composition will cover quite easily the upper part of the garments but, on the contrary, their bottom part will not be efficaciously reached. It must be noticed that in many garments, such as jackets, shirts, sweaters and the like it is the bottom part that wrinkles easily when in use, thus, for these clothes it might be disadvantageously necessary to repeat the dewrinkling cycle more than one time to obtain a good result.

Another drawback of the machine disclosed in U.S. Pat. No. 6,189,346 is that the use of a compressor to achieve a good nebulization of the conditioning composition is a noisy, expansive and cumbersome solution. Furthermore, for exhausting the air from the interior region the machine is provided with an exhaust air duct which presents the same drawbacks discussed above for the invention disclosed in U.S. Pat. No. 5,815,961.

Another important drawback of this kind of refreshing machine is that it cannot produce any result if it works without the prescribed chemical composition. For this reason, users are forced to a continuous disbursement for buying said composition. Additionally, users employing this chemical substance must be well instructed in order to avoid health problems and on how to behave in case of emergency.

Another example of refreshing machine using a conditioning composition is found in EP 1 182 292. This Patent Application discloses a collapsible or expandable container comprising an ultrasonic nebulizer for providing a mist, a heating element, a fan and a vent and/or a filter.

A part from the above discussed drawbacks in connection with the use of a chemical composition for treating clothes, another drawback of the mentioned machine is that said composition is nebulized in a chamber where it is mixed with the air flowing in horizontal direction. The mix is introduced from said chamber into the garments housing by an outlet port disposed on one side and internally to said housing. Consequently the distribution of the composition will be particularly rich on the side where the outlet port is disposed and quite poor on the opposite side. To this undesirable effect it contributes also the fact that the fan cannot operate a good air recirculation within the whole container, being disposed on its lower portion and on the opposite side in respect to the outlet port. Said recirculation is even disadvantageously obstructed by the clothes themselves hung within the container.

The aim of the present invention is therefore to solve the noted problems, eliminating the drawbacks of the cited known art and thus providing a clothes treating apparatus for refreshing garments that removes odours and wrinkles without using steam, mechanical tensioning devices or chemicals substances adapted to impart refreshing and/or cleaning benefits.

A further purpose of the present invention is to provide a clothes treating apparatus that enables a quick and inexpensive refreshing process that can be effective as soon as the apparatus is operated.

Another purpose of the present invention is to ensure an homogeneous distribution of the fluid circulation inside the garments housing in order to provide an homogeneous refreshment of the whole surface of the clothes stored and in order to enable the clothes themselves to be swelled out by the fluid stream.

A further purpose of the present invention is to provide a clothes treating apparatus in which the operating fluid stream recirculates in a closed loop without being exhausted from the apparatus to the atmosphere or intaken from the atmosphere to the apparatus when the latter is working.

A further purpose yet of the present invention is to provide a clothes treating apparatus that is compact and easy to install, having, preferably, a structure adapted to be built-in.

Anyway, features and advantages of the present invention may be more readily understood from the description that is given below by way of a non-limiting example with reference to the accompanying drawings, in which:

FIG. 1 is a front elevational view of a clothes treating apparatus according to the present invention;

FIG. 2 is a left side view in elevation of the clothes treating apparatus shown in FIG. 1;

FIG. 4 is a sectional view taken horizontally along line IV-IV of FIG. 1;

The present invention provides apparatuses using only water, heat and air for refreshing clothes. The refreshing process operated by the apparatuses within the scope of the herebelow described invention comprises essentially a first step in which the water is nebulized and diffused by heated air provided by a ventilator and a second step in which clothes are dryed by the heated air. If a refreshing is not needed, but a drying is desired, as when a cloth has been exposed to rain, the present apparatuses can be quickly activated to simply dry said cloth using heated air without the water nebulizing action.

All the functions of the present machine are controlled by an electronic control system which either receives user's inputs and gives operative instruction to the apparatus and/or receives diagnostic signals from the machine and informs the user.

Figure 3:
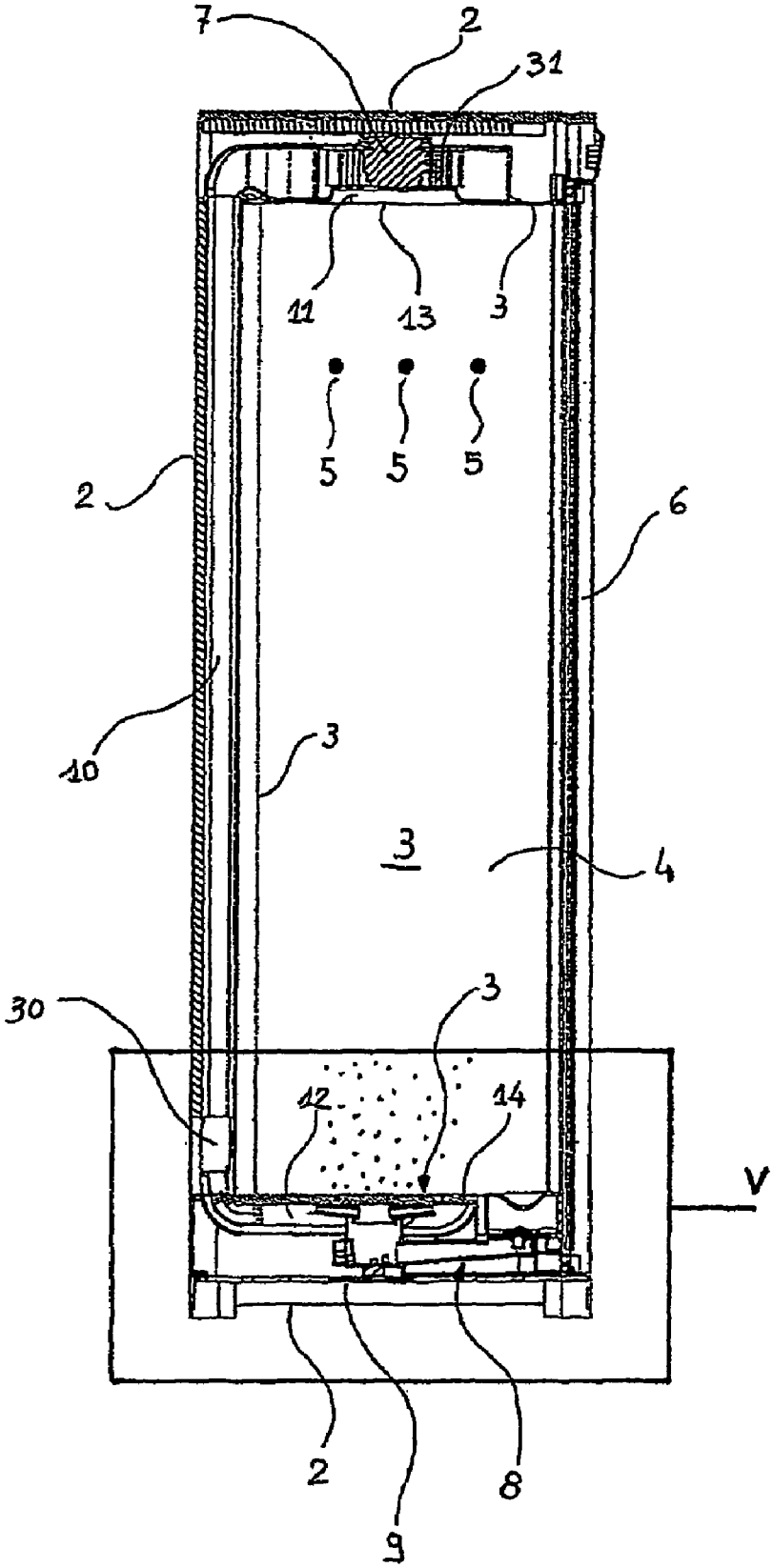
FIG. 3 is a sectional view taken vertically along line III-III of FIG. 1.

An overall view of a clothes treating apparatus according to the present invention is illustrated in FIGS. 1, 2 and 3 in which there can be substantially noticed a cabinet 1 having external walls 2 and internal walls 3 which define an interior region 4 adapted for receiving clothes to be treated. Said clothes can be hung on at least a supporting device 5 which can be a rod, a hanger or the like. Connected to the cabinet 1 there is a door 6 for accessing the interior region 4, and, referring particularly to FIG. 3, it can be seen as the apparatus according to the present invention is provided with a ventilator 7, which preferably is a centrifugal ventilator, water supply means 8 and an ultrasonic nebulizer 9 which is operatively associated to the water supply means 8 in order to produce a fine mist.

Said mist is formed causing a progressive detachment of small droplets from a water mass using ultrasonic waves generated by the ultrasonic nebulizer 9. The so produced mist can be available as soon as the apparatus is operated because it is not generated by heating water until it vaporizes. The appearance and the distribution of the mist is similar to that of the vapour produced in a steaming machine of known type, but the energy consumption and the time process are greatly reduced.

The natural tendency of the droplets detached from the water mass to rise is favoured by the action of the ventilator 7 which lets the air within the interior region 4 recirculate through an air duct 10 located between the internal walls 3 and the external walls 2. The air duct 10 forms a closed loop with said internal region 4 and, preferably, it is located on the opposite side of the cabinet 1 in respect to the door 6. The air duct 10 extends substantially along the whole height of the clothes treating apparatus and comprises an air intake port 11 and an outlet port 12 located at the top of the interior region 4 and at its bottom part respectively. Ports 11 and 12 are preferably covered by protective grates 13, 14 to prevent users from touching the working members of said apparatus. In the bottom part of the apparatus, the grate 14 acts as internal wall for the cabinet 1 defining the lower surface of said internal region 4. The particular ports arrangement generates a substantially vertical airflow within the interior region 4 so that clothes hung inside it can be swelled out and homogeneously passed through while they are refreshed.

Before being reintroduced into the interior region 4, the air is heated by heating means 30 disposed inside the air duct 10 and preferably in the bottom part of the cabinet 1. Although the refreshing process is quick and the air is constantly recirculated within the interior region 4, to prevent odours and/or undesiderable particles from redepositing on the clothes, filtering means 31 can be optionally included in the air duct 10 to purify the air.

Therefore the apparatus does not intake air from the atmosphere neither discharges air to the latter when it is working.

Figure 5:
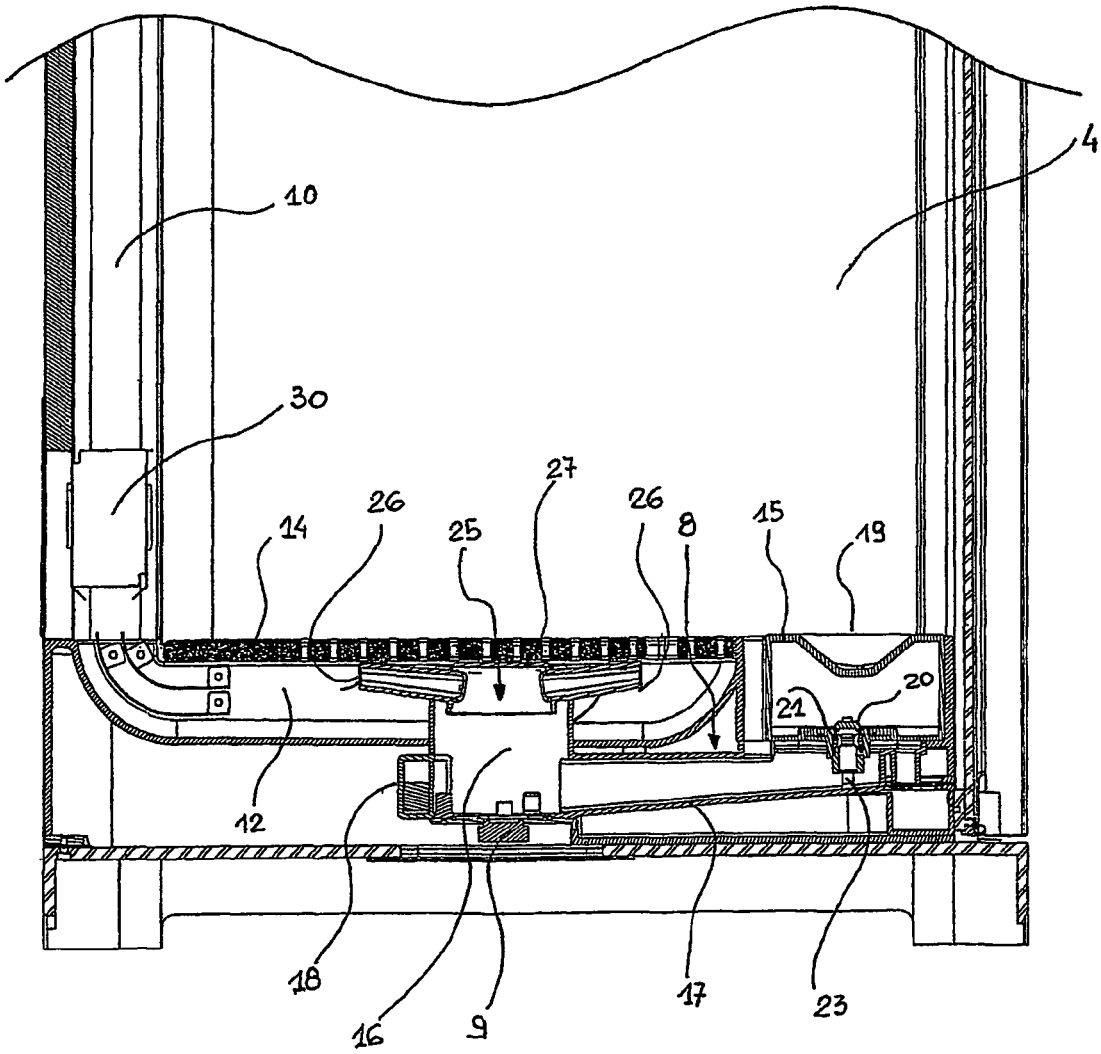
FIG. 5 is the enlarged view of detail V in FIG. 3.

FIG. 5 shows an enlarged view of the bottom part of the apparatus according to the present invention. It can be seen that said water supply means 8 comprises a removable water reservoir 15 feeding a pocket 16 which is hydraulically connected thereto by a pipe 17. Said pipe 17 allows to maintain a constant water level inside the pocket 16 so that the ultrasonic nebulizer 9 can always work with the most favourable quantity of water. Said water level is monitored by a water level measuring device 18 associated to the pocket 16. When the water level in the pocket 16 lowers, the measuring device 18 sends a signal to an electronic control system which controls all the working conditions of the clothes apparatus in order to advise the user to refill the reservoir 15.

Reservoir 15 is provided with a handle 19 for easily extracting it from its housing and it comprises a valve 20 which is biased downwardly by a spring 21. When the reservoir 15 is removed from its housing, the spring 21 biases the valve 20 to a closed position so that no water may exit through the valve 20, on the contrary, when the reservoir is inserted in its housing a projection 23 opens the valve 20 allowing water to pass into the pipe 17 and then into the pocket 16.

Pocket 16 is upwardly open and at least partly contained in the outlet port 12 so that, when the apparatus is operated, the mist produced by the ultrasonic nebulizer 9, which is preferably associated at the bottom of said pocket 16, can be mixed with at least a part of the air flowing from the air duct 10. In this way the mist is easily introduced within the interior region 4 of the apparatus.

An homogeneous diffusion of the mist in the interior region 4 can be obtained providing the grate 14, which covers the outlet port 12, with a plurality of slotted leaks 24 as shown in FIG. 4.

A conveyor 25 favours the mix between the air and the mist. In FIG. 5 it can be seen a sectional view of a preferred embodiment of the conveyor 25 mounted on the pocket 16. Said conveyor 25 comprises at least a tubular member 26 which protrudes from a central body 27 shaped as a frustum of a cone. Each tubular member 26 is preferably tapered and its longitudinal axis is tilted in respect of a horizontal direction.

Figure 6:
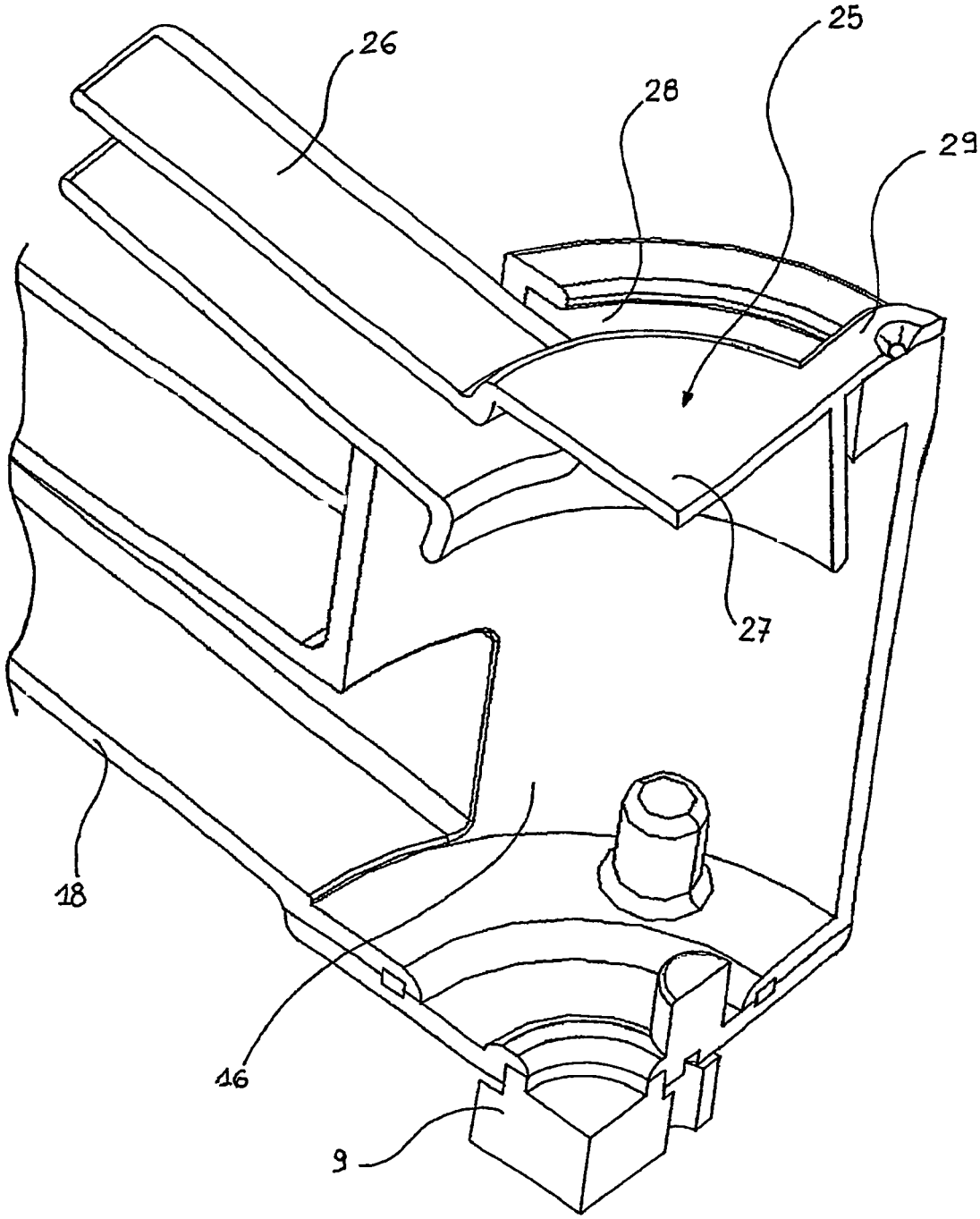
FIG. 6 is a sectional perspective view of the conveyor.

Referring now to FIG. 6, said conveyor 25 enables a part of the air flowing from the air duct 10 to be directed into the pocket 16. The air passes through said at least a tubular member 26 and enters the pocket 16. Inside the pocket 16 the air drags the nebulized water away forming a mix which can escape from said pocket 16 and accessing the internal region 4 passing through an annular interstice 28 comprised between the conveyor 15 and the pocket 16. Both the part of air conveyed to the pocket 16 both the remaining part of the flow recirculated by the air duct 10 help to create a homogeneous diffusion of the flow within the interior region 4.

The conveyor 25 is removably housed above the pocket 16 and it is held in position by more than one of said tubular member 26 and/or by a number of tabs 29 protruding from the central body 27.

In order to have a versatile apparatus which can be placed anywhere in a house, the cabinet 1 can be styled to well integrate with other home furniture and fittings or it can be adapted to be built-in.

Conclusively, it can therefore be stated that the clothes treating apparatus according to the present invention is a really multivalent and versatile appliance that can really provide an inexpensive and quick refreshing process, thereby doing away with the serious drawback shared by prior-art machines.

The invention claimed is:

1. A clothes treating apparatus comprising:

a cabinet (1) having external walls (2) and internal walls (3), said internal walls (3) defining an interior region (4) for receiving clothes;

a door (6) connected to said cabinet (1) for accessing said interior region (4);

at least a supporting device (5) for supporting clothes within said interior region (4);

a ventilator (7);

water supply means (8); and an ultrasonic nebulizer (9) operatively associated to said water supply means (8);

wherein the air within said interior region (4) is recirculated by said ventilator (7) through an air duct (10) located between said internal walls (3) and said external walls (2) forming a closed loop with said interior region (4).

2. A clothes treating apparatus according to claim 1 wherein said water supply means (8) comprising a removable water reservoir (15) feeding a pocket (16) hydraulically connected thereto.

3. A clothes treating apparatus according to claim 2 wherein said pocket (16) is associated with a water level measuring device (18) to monitor the absence of water inside said removable water reservoir (15).

4. A clothes treating apparatus according to claim 1, wherein said air duct (10) extends substantially along the whole height of said apparatus.

5. A clothes treating apparatus according to claim 1, wherein said air duct (10) includes heating means (30) to increase the temperature of the air.

6. A clothes treating apparatus according to claim 1, wherein said air duct (10) includes filtering means (31) to purify the air from odours and/or undesirable particles.

7. A clothes treating apparatus according to claim 1, wherein said air duct (10) is located on the opposite side of said cabinet (1) in respect to said door (6).

8. A clothes treating apparatus according to claim 1, wherein the recirculating airflow within said interior region (4) is oriented in a substantially vertical direction.

9. A clothes treating apparatus according to claim 1, wherein said air duct (10) comprises an air intake port (11) located at the top of said interior region (4) and an air outlet port (12) located at the bottom of said interior region (4).

10. A clothes treating apparatus according to claim 9 wherein said air intake port (11) and said air outlet port (12) are covered by a protective grate (13, 14).

11. A clothes treating apparatus according to claim 9 wherein said air outlet port (12) contains at least a part of said pocket (16).

12. A clothes treating apparatus according to claim 11 wherein said pocket is associated to a conveyor (25) which directs at least a part of the air flowing from said air duct (10) into said pocket (16) and allows said air mixed with the mist produced by the ultrasonic nebulizer (9) to escape from said pocket (16) accessing said interior region (4).

13. A clothes treating apparatus according to claim 12 wherein said conveyor (25) comprises a central body (27) shaped as a frustum of a cone and at least a tubular member (26) protruding therefrom.

14. A clothes treating apparatus according to claim 1, wherein said ventilator (7) is a centrifugal ventilator.

15. A clothes treating apparatus according to claim 1, wherein the working conditions of said apparatus are driven by an electronic control system.

16. A clothes treating apparatus according to claim 1, wherein said cabinet (1) has a structure adapted to be built-in.

17. A clothes treating apparatus according to claim 1, wherein said ultrasonic nebulizer (9) introduces nebulized water into said interior region (4).

18. A clothes treating apparatus according to claim 1, wherein said external walls (2) and said internal walls (3) are rigid, wherein said door (6) is hingedly connected to said cabinet (1), wherein all of the air within said interior region is cyclically recirculated along a closed path by said ventilator through the air duct (10), and wherein the air duct (10) is defined by a hollow space between said internal walls (3) and said external walls (2).

* * * * *